United States Patent [19]

Marino

[11] Patent Number: 4,524,457

[45] Date of Patent: Jun. 18, 1985

[54] CARGO BAG WITH REINFORCED TRIANGULAR LIFTING PANELS

[75] Inventor: Frank J. Marino, Hialeah, Fla.

[73] Assignee: Marino Technologies, Inc., Hialeah, Fla.

[21] Appl. No.: 605,110

[22] Filed: Apr. 30, 1984

[51] Int. Cl.[3] ..... B65D 33/06; B65D 88/16

[52] U.S. Cl. ..... 383/17; 383/24; 383/72; 383/117; 383/7

[58] Field of Search ..... 383/6, 7, 9, 10, 17, 383/20, 22, 24, 117, 71, 72, 23; 224/205

[56] References Cited

U.S. PATENT DOCUMENTS

| | | | |
|---|---|---|---|
| D. 135,538 | 4/1943 | Kaplan | 383/23 X |
| 217,362 | 7/1879 | Gardner | 383/7 X |
| 505,688 | 9/1893 | Wendell | 383/9 X |
| 784,559 | 3/1905 | Graham | 383/24 X |
| 1,374,960 | 4/1921 | Shipman | 383/22 X |
| 1,861,431 | 5/1932 | Crawford | 224/205 |
| 1,941,871 | 1/1931 | Struve | 383/72 |
| 2,189,174 | 2/1940 | Hohl | 383/120 X |
| 2,279,989 | 4/1942 | Hirschberg | 383/8 |
| 3,208,660 | 9/1965 | Brieske | 383/9 |
| 3,249,285 | 5/1966 | Dollheimer et al. | 383/9 |
| 3,961,655 | 6/1976 | Nattrass et al. | 383/71 X |
| 3,961,743 | 6/1976 | Hollowell | 383/7 |
| 4,136,723 | 1/1979 | Skaadel et al. | 383/7 |
| 4,191,229 | 3/1980 | Skaadel et al. | 383/7 |
| 4,211,266 | 7/1980 | Massey | 383/6 |
| 4,224,970 | 9/1980 | Williamson et al. | 383/117 X |
| 4,345,712 | 8/1982 | Gim | 383/7 |
| 4,356,853 | 11/1982 | Sekiguchi | 383/17 X |
| 4,479,243 | 10/1984 | Derby et al. | 383/24 |

FOREIGN PATENT DOCUMENTS

| | | | |
|---|---|---|---|
| 26287 | 4/1981 | European Pat. Off. | 383/7 |
| 523746 | 4/1931 | Fed. Rep. of Germany | 383/6 |
| 3204758 | 8/1983 | Fed. Rep. of Germany | 383/6 |
| 2286075 | 4/1976 | France | 383/22 |
| 1525949 | 9/1978 | United Kingdom | 383/117 |
| 1557784 | 12/1979 | United Kingdom | 383/7 |
| 1581438 | 12/1980 | United Kingdom | 383/7 |

*Primary Examiner*—William Price
*Assistant Examiner*—Sue A. Weaver
*Attorney, Agent, or Firm*—Bell, Seltzer, Park & Gibson

[57] ABSTRACT

Four triangular lifting panels are formed integrally with and extend upwardly from the upper edges of the side walls of the cargo bag. Each of the triangular lifting panels includes wide lower ends, inwardly tapering sides, and substantially pointed upper ends with the wide lower ends of the triangular lifting panels being integrally joined with at least one-half of the upper edges of at least two of the side walls on opposed sides of the cargo bag. In one embodiment, pairs of triangular lifting panels are formed integrally with opposed side walls so that the lifting stress is equally distributed to opposed side walls. In another embodiment, the four triangular lifting panels are formed integrally with and centered above the juncture of adjacent side walls so that the lifting stress is equally distributed to all four side walls. Lifting loop means is associated with the lifting panels for supporting and moving the cargo bag from one location to another.

4 Claims, 27 Drawing Figures

CARGO BAG WITH REINFORCED TRIANGULAR LIFTING PANELS

FIELD OF THE INVENTION

This invention relates generally to a cargo bag for the transportation and storage of bulk material and more particularly to such a cargo bag which includes reinforced triangular lifting panels formed integral with and extending upwardly from the upper edges of side walls of the cargo bag for distributing the lifting stress over wide areas of the side walls.

BACKGROUND OF THE INVENTION

It is generally known to provide cargo bags with lifting straps or panels for engagement by the tines of a forklift truck. It is the usual practice to provide woven lifting straps or webs which are attached by sewing to the side walls of the cargo bag and the lifting straps extend upwardly above the side walls and have a lifting loop formed at their upper ends. A typical cargo bag with lifting straps is illustrated in U.S. Pat. No. 4,224,970. The lifting straps of this patent are sewn to substantially the full length of the side walls of the cargo bag. However, substantially all of the lifting stress is concentrated on the area of the side walls immediately adjacent the point at which the straps are attached thereto. This concentration of the lifting stress in the areas of the bag material closely adjacent the straps has a tendency to tear the bag material and thereby limits the weight capacity of the cargo bag, particularly during lifting operations.

In order to more uniformly distribute the lifting stress it has been proposed that cargo bags be provided with lifting panels formed by folding over the upper ends of the side wall material to form lifting loops of substantially the same width as the corresponding side wall. While this type of lifting loop is effective to more uniformly distribute the lifting stress along the area of the side walls, the wide lifting loops are difficult to thread onto the lifting tines of a forklift truck. Typical examples of cargo bags with relatively wide lifting loops formed of the side wall material are illustrated in U.S. Pat. Nos. 3,292,813; 4,136,723; and 4,191,229.

SUMMARY OF THE INVENTION

With the foregoing in mind, it is an object of the present invention to provide a cargo bag with reinforced triangular lifting panels formed integrally with and extending upwardly from the upper edges of the side walls to more uniformly distribute the lifting stress and with lifting loop means supported on the lifting panels which may be easily moved onto and removed from the tines of a forklift truck.

In each embodiment of the present invention, the triangular lifting panels are reinforced by having inwardly folded panels positioned adjacent and connected to the main triangular lifting panels which are integrally formed at their lower edge with the upper edges of the side walls of the cargo bag. Each of the triangular lifting panels includes a wide lower end formed integrally with the upper edges of the side wall and inwardly tapering sides with a substantially pointed upper end. The upper ends of the several embodiments of the present cargo bag may be provided with suitable closure sleeves or panels and the lower ends of the several embodiments of the bags may also be provided with suitable closure panels and/or with a bottom discharge opening.

In one embodiment of the present cargo bag, the medial portion of the upper ends of a pair of opposed side walls are vertically slit and triangular portions of the material adjacent each side of each of the slits are folded inwardly to provide a pair of adjacent triangular reinforced lifting panels on the upper edge of each of the pair of opposed side walls. Each of the triangular lifting panels includes four triangular panels being joined to each other by fold lines and with the outermost of the triangular panels being integrally formed along its lower wide edge with the upper edge of the respective pair of opposed side walls. The inwardly tapering sides of the triangular lifting panels are joined to each other by stitching lifting strap material along the inwardly inclined edges and forming an upstanding loop extending upwardly from the upper pointed end of each lifting panel so that the lifting loop is readily accessible for engagement by the tines of a forklift truck. When this embodiment of the cargo bag is fully loaded and lifted, the lifting stress is evenly distributed over the entire width of the pair of opposed side walls of the bag so that the lifting stress is equally divided between opposite sides of the bag and is not concentrated in narrow areas of the bag.

In a second embodiment of the present cargo bag, vertical slits are formed in the medial portions of the upper ends of each of the four side walls. Portions of the material adjacent the vertical slits are folded inwardly along diagonal lines extending from the bottom of the slit and upwardly to the edge of the material above each corner of the bag so that each triangular lifting panel has an upper pointed end positioned above each corner of the bag and a lower wide end formed integrally with the material forming one-half of the width of each adjacent side wall. Each triangular lifting panel includes an outer triangular panel integral along its lower end with half of adjacent side walls and an inner panel formed of a pair of adjacent inwardly folded triangular panels. Lifting loop means is supported by each of the lifting panels for easy reception of the tines of a forklift so that the lifting stress is uniformly distributed throughout all four side walls of the cargo bag.

In each embodiment of the cargo bag, the lifting loop means may be provided by strap members or webbing sewn around the edges of the triangular lifting panels and forming upstanding loops above the pointed upper end of each of the lifting panels. Alternatively, the lifting loop means of the triangular lifting panels of the second embodiment of the cargo bag may be formed by substantially circular openings cut in the triangular lifting panels and bound by sewing lifting strap material around the opening. Also, the opening may be reinforced by molding a grommet around the opening.

BRIEF DESCRIPTION OF THE DRAWINGS

Other objects and advantages will appear as the description proceeds when taken in connection with the accompanying drawings, in which.

DESCRIPTION OF THE ILLUSTRATED EMBODIMENTS

Generally, the cargo bag of the present invention is formed of flexible material which usually includes an outer layer of woven polypropylene having an inner layer of plastic film material adhered thereto. The woven polypropylene affords strength and durability while the plastic film serves as a flexible moisture barrier so that the material within the bag is protected during transportation and storage. The cargo bag includes upstanding side wall means, illustrated as four side walls, a bottom, and an upper filling opening. The cargo bag of the present invention is particularly characterized by four upstanding side walls and four triangular lifting panels formed integrally with and extending upwardly from the side walls. Each of the triangular lifting panels includes wide lower ends with inwardly tapering sides and substantially pointed upper ends. The wide lower ends of one ply of each of the triangular lifting panels is integrally joined with at least one-half of the upper edges of at least two of the side walls on opposed sides of the cargo bag. Lifting loop means is supported by the lifting panels for supporting and moving the cargo bag from one location to another and the lifting loop means is relatively narrow for ease of entry and exit by the tines of a forklift. The triangular lifting panels serve to distribute the weight of the material in the cargo bag over the width of at least two of the side walls when the cargo bag is lifted by the lifting loop means.

The Embodiment of FIGS. 1–6

Figure 1:
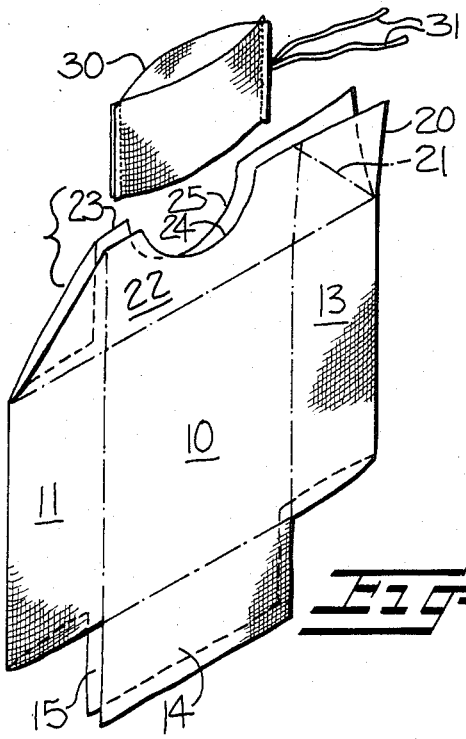
FIG. 1 is an exploded isometric view of the blank from which one embodiment of the present cargo bag is formed and illustrating the manner in which the medial portions of opposed side walls are vertically slit and folded inwardly.
Figure 3:
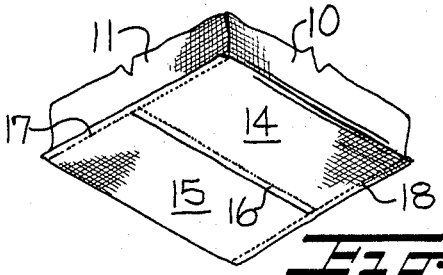
FIG. 3 is a fragmentary isometric view looking upwardly at the bottom of the bag of FIG. 2 and illustrating the manner in which the bottom is closed.

As illustrated in FIG. 1, the blank for forming the cargo bag can be formed of tubular woven flexible material or from a rectangular piece of flexible material folded and seamed vertically along adjoining edges thereof. As indicated by the dash-dot fold lines in FIG. 1, the cargo bag includes vertical side walls 10–13 and lower extensions or bottom flaps 14, 15 extending downwardly from the lower edges of the respective side walls 10, 12. The bottom of the cargo bag is formed by inwardly folding the flaps 14, 15 and sewing their inner edges together along a seam 16 extending transversely across the bottom (FIG. 3). The opposite side edges of the flaps 14, 15 are stitched to the lower edges of the respective opposite side walls 11, 13, as by corresponding seams means 17, 18.

In order to form the triangular lifting panels and the upper filling opening, the tubular blank is flattened, as illustrated in FIG. 1, and vertical slits 20 are formed down the fold lines extending along the medial portion of the opposed side walls 11, 13. The triangular portions adjacent opposite sides of each of the slits 20 are folded inwardly, as indicated by the dash-dot fold line 21 in the upper right-hand corner of FIG. 1 to produce two-ply triangular portions, as indicated on the left-hand upper corner of FIG. 1. Top panels 22, 23 extend upwardly from the respective side walls 10, 12 and include central semi-circular cutouts 24, 25.

An upstanding filler sleeve or collar 30 is formed of either tubular woven fabric or by seaming opposite edges of a pair of rectangular pieces of material, as illustrated in FIG. 1, and the inner ends of closure tie strings 31 are incorporated in one of the seams. Adjacent inner edges of the top panels 22, 23 are seamed together and the lower edge of the sleeve or collar 30 is seamed to the circular opening formed by the semicircular cutouts 24, 25, as indicated in FIG. 2.

Figure 2:
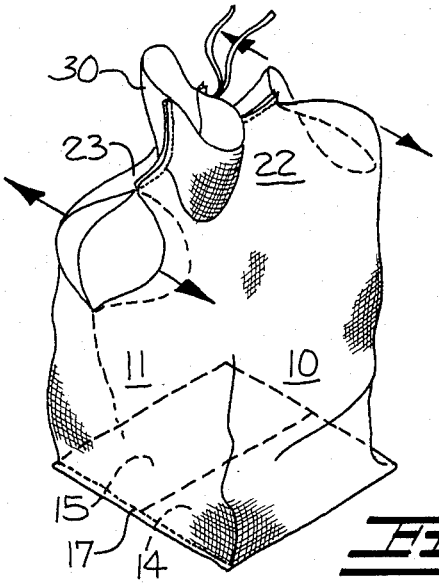
FIG. 2 is an isometric view of the blank of FIG. 1 with the bottom closed and illustrating a further step in the formation of the triangular lifting panels.

The two-ply portions at the upper ends of the opposite side walls 11, 13 are then folded outwardly, as indicated in FIG. 2, to provide two triangular lifting panels 32, 33 on the upper end of the side wall 11, and two triangular lifting panels 32', 33' on the upper end of the side wall 13. Each of the triangular lifting panels 32, 33, 32' and 33' is provided with four triangular plies, each of which has a wide lower end, inwardly tapering sides and substantially pointed upper ends. Adjacent pairs of the plies of each of the lifting panels are joined together by fold lines while the wide lower end of the outer ply of each lifting panel is integrally joined with one-half of the upper edges of the respective side walls 11, 13. The lower edges of each of the triangular plies are preferably joined together by respective rows of stitching 35, 35' extending along the upper edge of the respective side walls 11, 13 (FIG. 5).

Lifting loop means is then supported on the lifting panels by stitching one end of a continuous piece of strap or webbing material 40 to the upwardly inclined side edge portion of the lifting panel 33, forming a lifting loop 41 extending upwardly above the lifting panel 33, stitching the webbing material down the opposite tapering side of the lifting panel 33 and then up the adjacent inclined side of the lifting panel 32 to form a second lifting loop 42 (FIG. 5), and then stitching the tail end of the strap material 40 along the edge portion of the opposite tapering side of the lifting panel 32. A single strip of web material is similarly attached to the lifting panels 32', 33' extending upwardly from the opposite side wall 13 to provide respective lifting loops 44, 45 extending upwardly therefrom. The web material is sufficiently stiff that the lifting loops 41, 42, 44 and 45 normally extending upwardly in the position shown in FIG. 5 so that they are in position to have the tines of a forklift truck inserted therein for lifting the cargo bag and easily removed therefrom when the cargo bag is positioned in the desired location.

Figure 5:
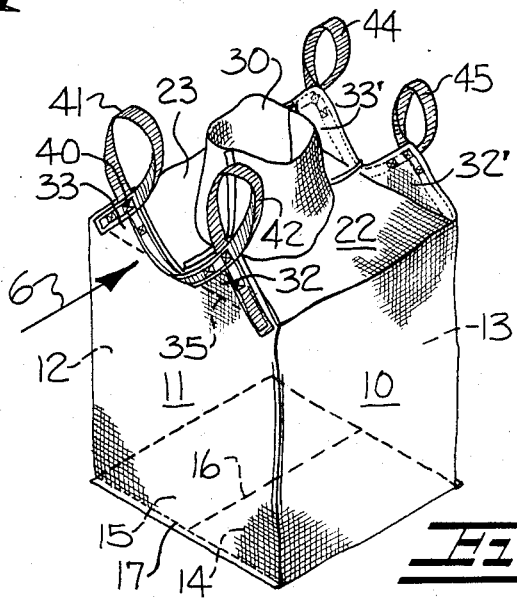
FIG. 5 is an isometric view of the bag illustrating the manner in which the lifting straps are attached to and form lifting loops extending upwardly from the pairs of triangular lifting panels associated with opposite side walls of the cargo bag.
Figure 4:
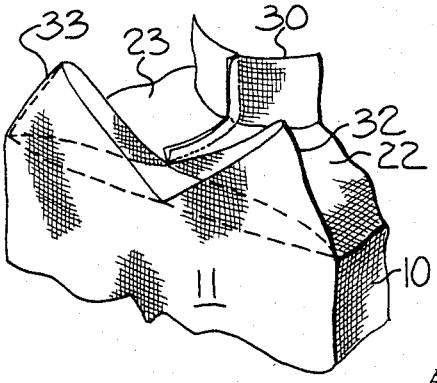
FIG. 4 is a fragmentary isometric view of one side of the upper portion of the bag of FIG. 2 and illustrating the further folding of the triangular lifting panels to provide a pair of triangular lifting panels integral with one side wall.
Figure 6:
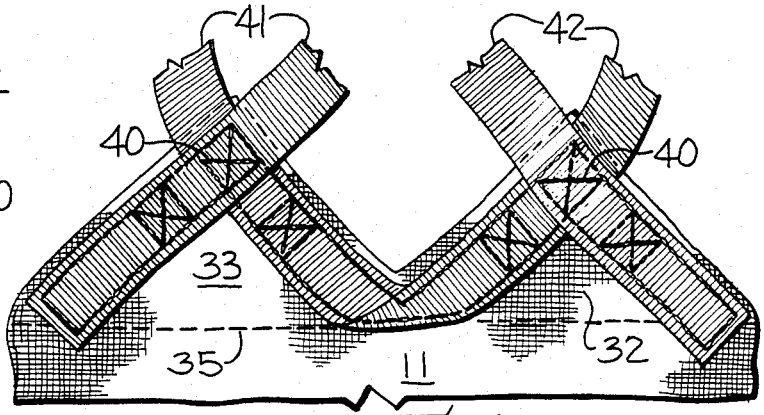
FIG. 6 is an enlarged fragmentary elevational view looking in the direction of the arrow 6 in FIG. 5 and illustrating the manner in which the lifting straps are attached to the inclined opposite tapering sides of the triangular lifting panels.

As will be noted in FIG. 5, the triangular lifting panels 32, 33 have their wide lower ends integrally joined with one-half of the width of the upper edge of the side wall 11 while the triangular lifting panels 32', 33' have their wide lower ends integrally joined with one-half of the width of the upper edge of the corresponding side wall 13. Thus, the weight of the material in the cargo bag is equally distributed between the opposed side walls 11 and 13 and the lifting stress imparted to these side walls by the lifting loops and the triangular lifting panels is uniformly distributed across the width of the side walls 11 and 13.

The Embodiment of FIGS. 7–12

Figure 7:
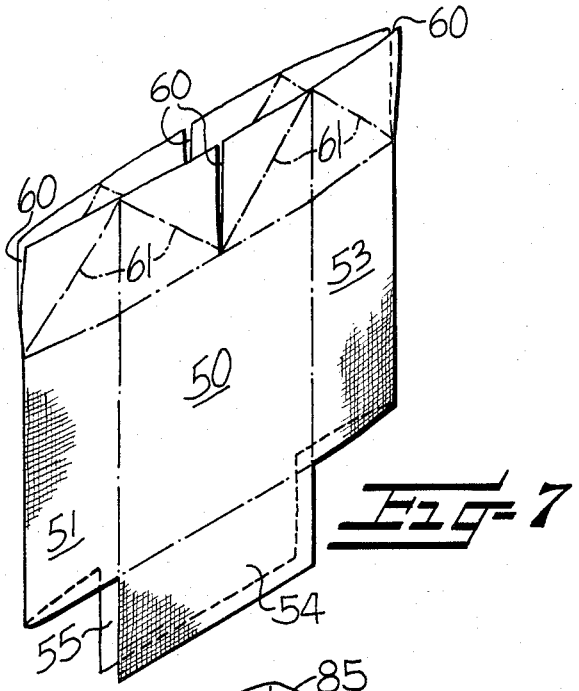
FIG. 7 is a view similar to FIG. 1 but illustrating the manner in which the material blank is vertically slit to form a second embodiment of the cargo bag.

As illustrated in FIG. 7, this embodiment of the cargo bag is either formed from a tubular woven flexible fabric or from rectangular flexible fabric vertically seamed to form a tube. Dash-dot fold lines are indicated at FIG. 7 to delineate the four upstanding side walls 50–53 and bottom panels 54, 55 extend downwardly from the lower edges of the respective side walls, 50, 52. The bottom panels 54, 55 are folded inwardly and their adjacent edges are connected together by a seam 56 extending transversely between the side walls 51, 53. Side seams 57, 58 join the opposite sides of the bottom panels 54, 55 to the lower edges of the side walls 51, 53 to provide a closed bottom in the cargo bag.

Figure 8:
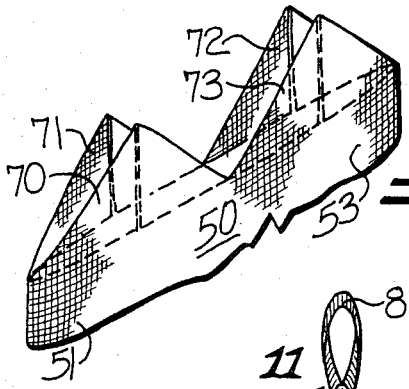
FIG. 8 is a fragmentary isometric view of the upper end of the cargo bag with the triangular lifting panels extending upwardly therefrom and in folded condition.

In order to form the triangular lifting panels and the upper filling opening, the tubular blank is flattened, as illustrated in FIG. 7, and vertical slits 60 are formed down the fold lines extending through the medial portion of the opposed side walls 51, 53. Vertical slits 60 are also formed in the medial portion of the side walls 50, 52. Triangular portions adjacent each side of each of the slits 60 are folded inwardly as indicated by the dash-dot fold lines 61 to form upstanding triangular lifting panels 70–73, as illustrated in FIG. 8.

Each of the triangular lifting panels 70–73 is provided with an outer ply having a wide lower end integrally formed with the upper edge of one-half the width of the adjacent side walls and with inwardly tapering sides extending to a substantially pointed upper end. The inwardly folded portions form an inner ply for each of the triangular lifting panels 70–73. The inner edges of the triangular inner panels are preferably connected to the outer panel by lines of stitching.

Lifting loop means is supported on the lifting panels 70–73 by stitching one end of a continuous piece of strap or web material 80 along the upwardly inclined side edge portions of each of the lifing panels 70–73 while forming a lifting loop extending upwardly above each of the lifting panels 70–73, as indicated respectively at 80–83. The web material is sufficiently stiff that the lifting loops 80–83 normally extend upwardly in the position shown in FIG. 9 so that they are above each corner of the cargo bag and in position to have the tines of a forklift truck inserted therein for lifting the cargo bag and easily removed therefrom, when the cargo bag is positioned in the desired location.

Figure 10:
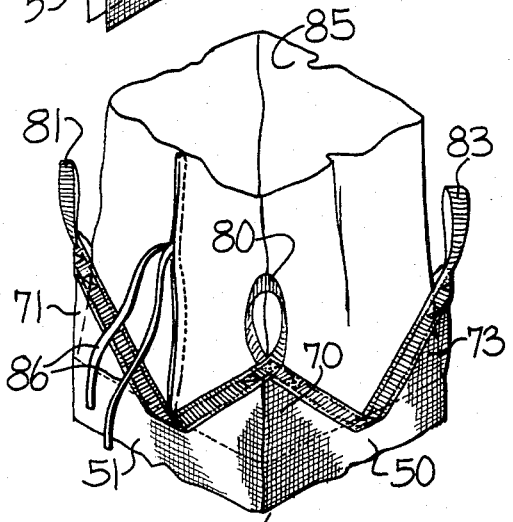
FIG. 10 is a view similar to the upper portion of FIG. 9 but illustrating the closure sleeve in a raised and open position.
Figure 11:
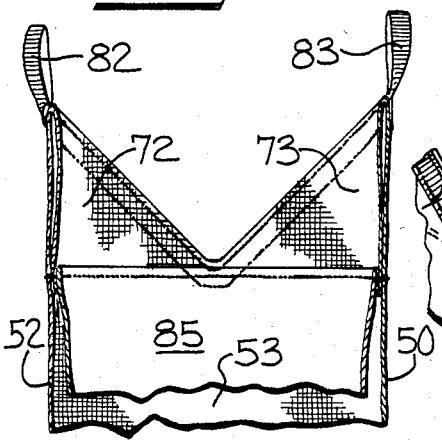
FIG. 11 is a transverse vertical sectional view taken along line 11—11 in FIG. 9 with the closure sleeve extending downwardly inside of the cargo bag.
Figure 12:
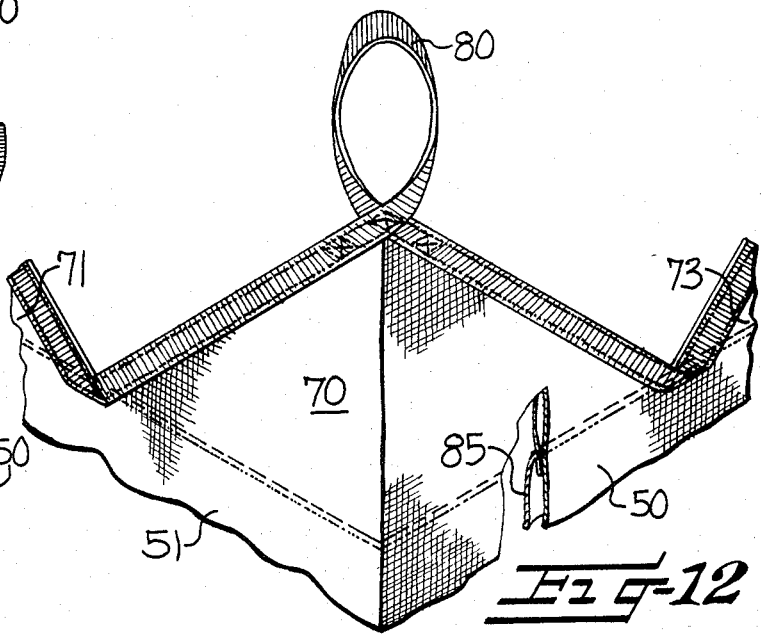
FIG. 12 is a fragmentary isometric view of one corner of the bag with parts broken away to illustrate the manner in which the upper edge of the closure sleeve is attached to the upper edge of the cargo bag.
Figure 13:
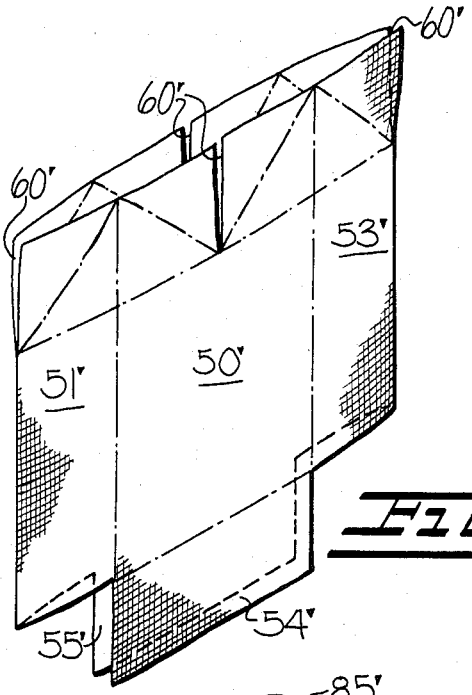
FIG. 13 is a view similar to FIG. 7 and illustrating the cargo bag blank with its upper end being vertically slit.

In order to provide a closure for the upper end of the cargo bag, a tubular sleeve 85 is sewn at one end to the upper edge portion of the side walls 50–53 (FIGS. 11 and 12) and normally extends down inside of the cargo bag. When the cargo bag is ready to be filled, the sleeve 85 is drawn upwardly, as illustrated in FIG. 10, so that the upper end of the cargo bag is open and ready for filling of material therein. After the cargo bag is filled, the sleeve 85 may be gathered together adjacent the upper end thereof and held in the gathered-together condition by tie strings 86, the inner ends of which are fixed in a vertical seam in the sleeve 85.

As will be noted, the triangular lifting panels 70–73 and the corresponding lifting loops 80–83 are centered over each corner of the cargo bag and their lower ends are integral with and extend over half of the width of the adjacent side walls 50–53. When the cargo bag is lifted by the lifting loops 80–83, the weight of the material in the bag is evenly and uniformly distributed over the full width of each of the side walls. Thus, the stress of lifting the cargo bag is evenly distributed around the entire periphery of the cargo bag and is not concentrated in any particular location to thereby reduce the likelihood of ripping and tearing of the cargo bag.

The Embodiment of FIGS. 13–18

Figure 14:
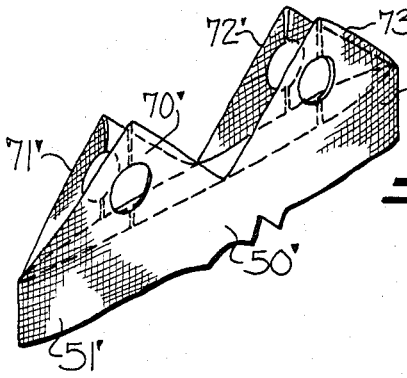
FIG. 14 is a fragmentary isometric view of the upper end of the blank of FIG. 13 with the triangular lifting panels being provided with lifting loops formed by circular openings cut therein.
Figure 18:
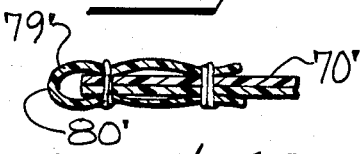
FIG. 18 is an enlarged sectional view taken substantially along the line 18—18 in FIG. 17 and illustrating the manner in which the strap web material is sewn to the peripheral surface of the circular cutout to form the lifting loop means therein.
Figure 17:
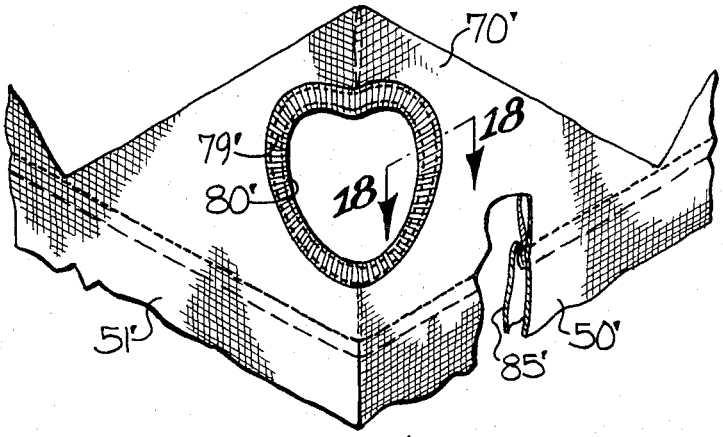
FIG. 17 is an enlarged fragmentary isometric view of one corner of the cargo bag with portions broken away to illustrate the manner in which the closure sleeve is connected to the inner periphery of the upper end of the bag.
Figure 19:
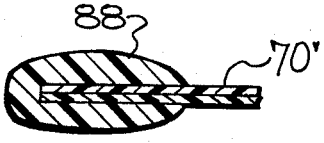
FIG. 19 is a view similar to FIG. 18 but showing the manner in which a plastic grommet is molded around the edge of the circular opening to form the lifting loop means.

The cargo bag of this embodiment is identical to the cargo bag of the embodiment shown in FIGS. 7–12 except that it contains a different type of lifting loop means. Therefore, the same reference characters applied to the parts of the embodiment of FIGS. 7–12 are applied to the corresponding parts of the embodiment of FIGS. 13–18 with the prime notation added. As illustrated in FIG. 14, the triangular lifting panels 70′–73′ are provided with circular openings around which web material 79′ is sewn, as illustrated in FIG. 18, to provide corresponding lifting loop openings 80′–83′ in the respective lifting panels 70′–73′. The webbing 79′ surrounding the lifting openings 80′–83′ thus provides a binding for the openings and aids in maintaining the openings in position so that the tines of a forklift truck may be easily inserted into and removed from these lifting loop openings. As an alternative, the lifting loop openings may be provided with molded-in-position plastic grommets 88, as illustrated in FIG. 19.

FIGS. 20–27

Figure 9:
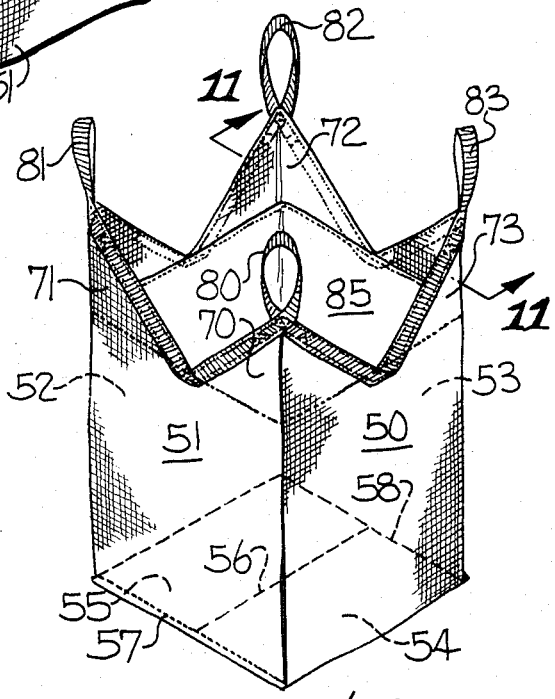
FIG. 9 is an isometric view of the second embodiment of the cargo bag and illustrating the manner in which the strap material is attached to the triangular lifting panels to form lifting loops therewith at the upper ends at each of the triangular lifting panels.
Figure 15:
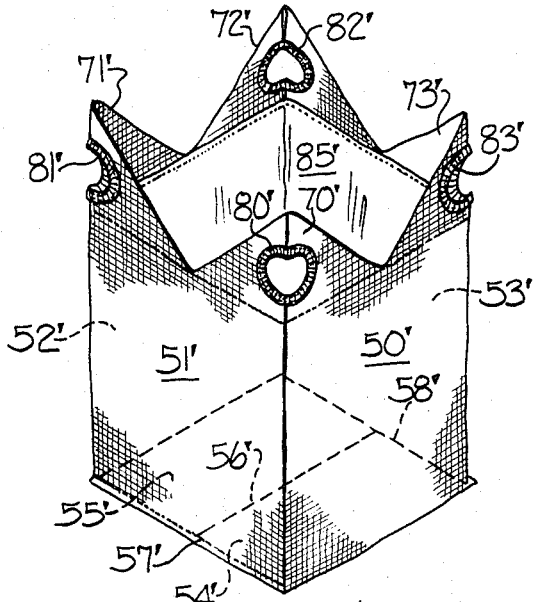
FIG. 15 is an isometric view of the cargo bag with the circular openings in each of the triangular lifting panels being provided with a strap web material sewn thereto.
Figure 16:
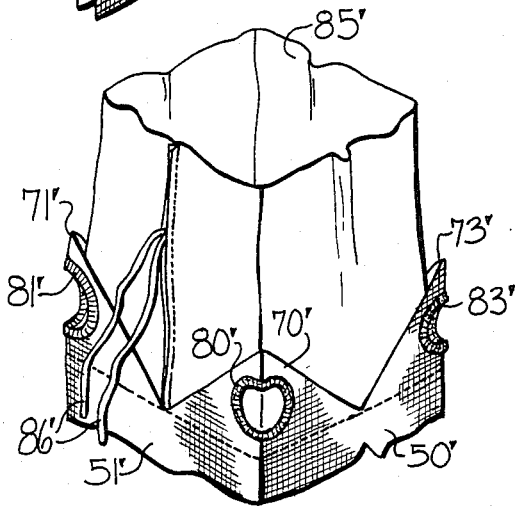
FIG. 16 is a fragmentary isometric view of the upper end portion of the cargo bag with the sleeve closure in raised condition for receiving material therein.
Figure 20:
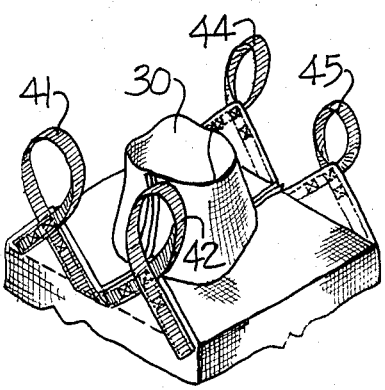
FIGS. 20–22 are fragmentary isometric views of the upper portions of the bags illustrated in respective FIGS. 5, 9 and 15 and illustrating a comparison between the different embodiments of the triangular lifting panels and the lifting loop means associated therewith.
Figure 21:
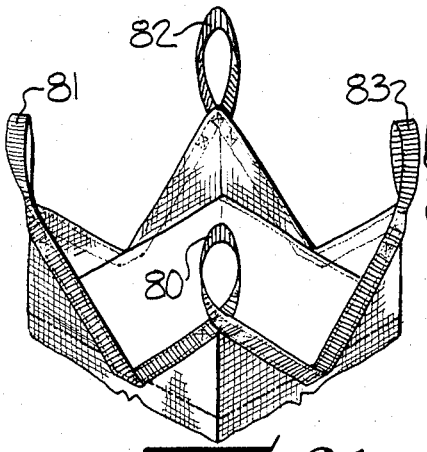
Figure 22:
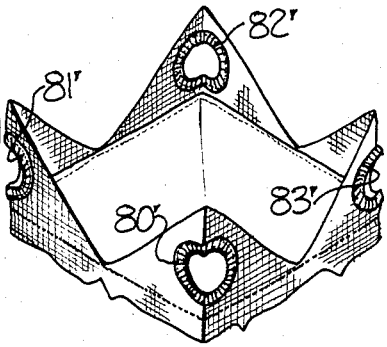
Figure 23:
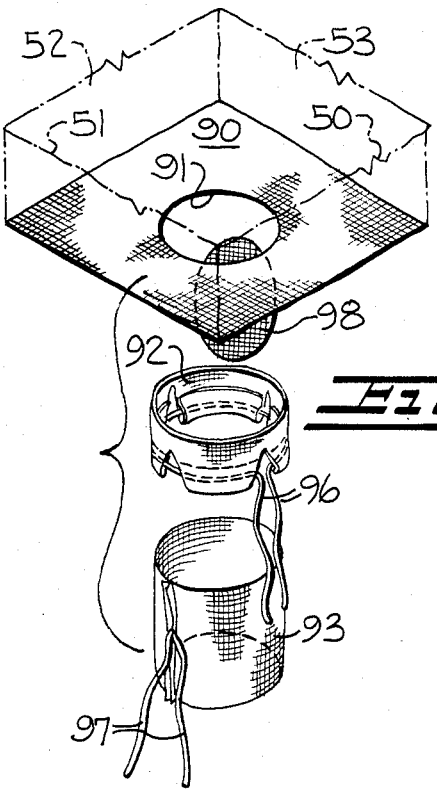
FIG. 23 is a fragmentary isometric view of the bottom of any one of the embodiments of the cargo bags provided with a discharge bottom, shown in exploded condition.
Figure 24:
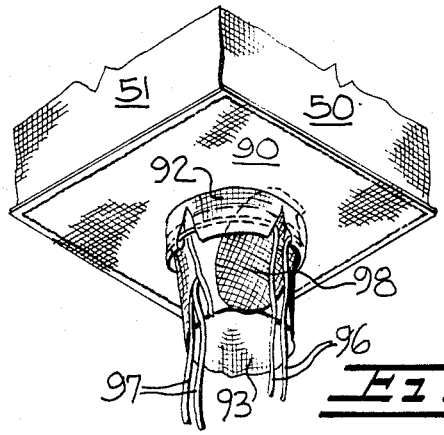
FIG. 24 is an isometric view looking up at the bottom of the cargo bag of FIG. 23 with the bottom discharge opening in assembled condition and open.
Figure 27:
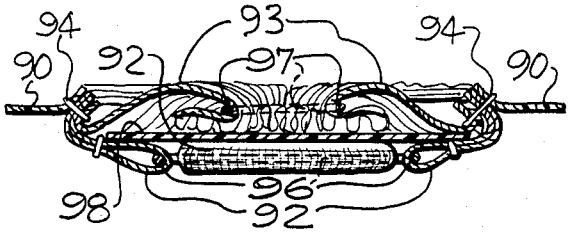
FIG. 27 is an enlarged sectional view taken substantially along the line 27—27 in FIG. 26 and illustrating the bottom closure opening in closed condition.

FIGS. 20–22 illustrate the upper ends of the embodiments of the cargo bag shown in respective FIGS. 5, 9 and 15 and are repeated in order to emphasize the fact that the bottom of the cargo bag may be formed in several different ways, including that earlier described, as well as the bottom discharge arrangement illustrated in FIGS. 23–27. The bottom discharge opening includes a bottom panel 90, the outer peripheral edges of which are connected to the side walls 50–53, as by a line of stitching, and the center portion is provided with a circular discharge opening 91. The upper ends of a closure sleeve 92 and a chute sleeve discharge 93 are connected to the opening 91 by a line of stitching 94 (FIG. 27) to securely connect the upper ends of the closure sleeve 92 and the chute sleeve 93 to the edge of the opening 91 in the bottom panel 90. The lower end of the closure sleeve 92 is provided with a hem having darts cut therein and threaded with a tie string 96. A tie string 97 is secured at its inner ends in a vertical seam in the chute sleeve 93 (FIG. 23). A circular closure panel 98 is provided to be inserted between the closure sleeve 92 and the chute sleeve 93, as illustrated in FIG. 27.

Figure 25:
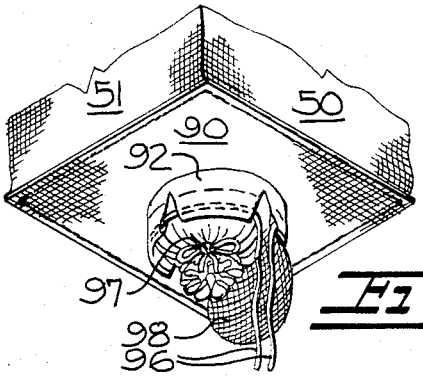
FIG. 25 is a view similar to FIG. 24 but showing the center opening discharge bottom in partially closed condition.
Figure 26:
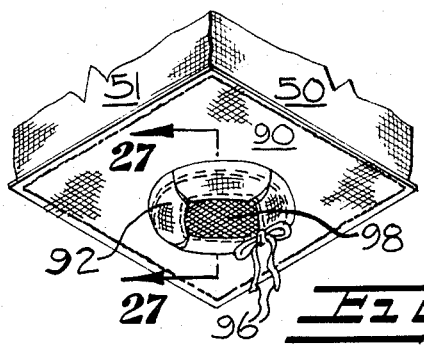
FIG. 26 is a view similar to FIG. 25 but showing the bottom discharge opening in fully closed condition.

To close the bottom of the cargo bag, in preparation for receiving material therein, the discharge sleeve 93 is gathered together and closed by tying the string 97 therearound, as illustrated in FIG. 25. The discharge sleeve 93 is then pushed up into the lower end of the closure sleeve 92 and the bag and the circular closure panel 98 is placed over the discharge chute 93. The drawstring 96 is then tightened and tied to bring the inner peripheral surface of the lower end of the closure sleeve 92 closer together, as illustrated in FIG. 26 and maintain the bottom in closed condition. In order to open the bottom to discharge the materials therefrom, it is merely necessary to untie the drawstring 96, thereby releasing the closure sleeve 92, remove the circular closure panel 98 and untie the drawstring 97 maintaining the discharge sleeve 93 in closed condition. The materials in the bag will then flow through the discharge sleeve 93 to be discharged from the cargo bag.

In each of the illustrated embodiments of the cargo bag, the lifting loop means is supported by triangular-shaped lifting panels, each of which includes lower wide ends, inwardly tapering sides, and substantially pointed upper ends with the wide lower ends of each of the triangular lifting panels being integrally joined with at least one-half of the upper edges of at least two of the side walls on opposed sides of the cargo bag. As illustrated in FIG. 5, the triangular lifting panels 33, 35 are each integrally joined at their lower ends with one-half of the upper edge of the side wall 11, while the triangular lifting panels 32′, 33′ are each integrally joined with one-half of the upper edge of the side wall 13. Thus, the lifting stress of the cargo bag in FIG. 5 is evenly distributed over the opposed side walls 11, 13. In the embodiment of the cargo bag illustrated in FIGS. 9 and 15, the triangular lifting panels 70–73 are integrally joined at their lower wide ends to one-half of the upper edges of each of the adjacent pairs of side walls 50–53. In this embodiment of the invention, the lifting stress is evenly distributed throughout all four side walls of the cargo bag.

In the drawings and specification there has been set forth the best modes presently contemplated for the practice of the present invention, and although specific terms are employed, they are used in a generic and descriptive sense only and not for purposes of limitation, the scope of the invention being defined in the claims.

That which is claimed is:

1. A cargo bag of flexible material for transportation and storage of bulk material and including four upstanding side walls, a bottom, and an upper filling opening, said cargo bag being characterized by four triangular lifting panels formed integrally with and extending upwardly from the upper edge of said side walls, said triangular lifting panels each including wide lower ends, inwardly tapering sides, and substantially pointed upper ends, said substantially pointed upper end of each of said triangular lifting panels being positioned above a corresponding corner of said cargo bag, said wide lower ends of each of said triangular lifting panels being integrally joined with and extending upwardly in substantial alignment with half of the upper edges of two adjacent side walls, and lifting loop means supported by said lifting panels for supporting and moving said cargo bag from one location to another whereby said triangular lifting panels serve to distribute the weight of the material over the width of all of said side walls when said cargo bag is lifted by said lifting loop means, wherein said lifting loop means comprises strap web material extending along and secured to the inwardly tapering sides of said triangular lifting panels, and said strap web material extending upwardly from the substantially pointed upper end of each of said triangular lifting panels and forming a lifting loop thereabove.

2. A cargo bag according to claim 1 wherein the portions of said strap web material secured to each of said inwardly tapering sides of adjacent of said triangular lifting panels are joined to each other in the central portion of the upper edge of said side walls.

3. A cargo bag according to claim 2 wherein each of said triangular lifting panels includes inner and outer plies of material.

4. A cargo bag according to claim 3 wherein said inner ply of each of said triangular lifting panels comprises inwardly folded portions integral with said outer ply and forming fold lines extending along said inwardly tapering sides of said triangular lifting panels.

* * * * *